US012790913B2

(12) United States Patent
Nicholson

(10) Patent No.: US 12,790,913 B2
(45) Date of Patent: Nov. 10, 2026

(54) PRESSURE COMPENSATED FEEDTRHOUGH ASSEMBLY

(71) Applicant: OneSubsea IP UK Limited, London (GB)

(72) Inventor: Joseph Allan Nicholson, Barrow-in-Furness (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 19/198,776

(22) Filed: May 5, 2025

(65) Prior Publication Data

US 2025/0341146 A1 Nov. 6, 2025

Related U.S. Application Data

(60) Provisional application No. 63/642,401, filed on May 3, 2024.

(51) Int. Cl.

| | |
|---|---|
| ***E21B 33/12*** | (2006.01) |
| ***E21B 17/02*** | (2006.01) |
| *E21B 33/038* | (2006.01) |

(52) U.S. Cl.

CPC ..... *E21B 33/1208* (2013.01); *E21B 17/028* (2013.01); *E21B 33/0385* (2013.01)

(58) Field of Classification Search

CPC . E21B 17/028; E21B 33/1208; E21B 33/0385
See application file for complete search history.

(56) References Cited

U.S. PATENT DOCUMENTS

| | | | | |
|---|---|---|---|---|
| 9,660,374 | B2 | 5/2017 | Baudelocque | |
| 9,761,962 | B2 | 9/2017 | Nicholson | |
| 11,217,909 | B2 | 1/2022 | Butler | |
| 2010/0193200 | A1* | 8/2010 | Rioufol | E21B 17/1035 166/387 |
| 2016/0276775 | A1* | 9/2016 | Nicholson | H01R 13/17 |
| 2017/0204680 | A1* | 7/2017 | Leismer | E21B 17/042 |
| 2017/0284117 | A1* | 10/2017 | Volin | E04H 15/46 |
| 2018/0128057 | A1* | 5/2018 | Mendez | E21B 17/028 |

* cited by examiner

*Primary Examiner* — Yong-Suk (Philip) Ro
(74) *Attorney, Agent, or Firm* — Kyle R. Miiller

(57) ABSTRACT

A receptacle for a downhole system includes a pressure seal for isolating a first pressure and a second pressure, and a transmission pin passes through the pressure seal. A pressure compensation chamber is positioned within the receptacle between the first pressure and the second pressure and has a chamber pressure sealed from the first pressure and the second pressure. The transmission pin is partially positioned in the pressure compensation chamber, and a pressure compensation device is positioned in the pressure compensation chamber for equalizing the chamber pressure with the first pressure.

7 Claims, 11 Drawing Sheets

PRESSURE COMPENSATED FEEDTRHOUGH ASSEMBLY

CROSS-REFERENCE TO RELATED APPLICATION

This application claims priority to and the benefit of U.S. Provisional Patent Application Ser. No. 63/642,401, filed on May 3, 2024, entitled "PRESSURE COMPENSATED FEEDTHROUGH ASSEMBLY," the entirety of which is hereby incorporated by reference for all purposes.

BACKGROUND OF THE DISCLOSURE

Hydrocarbon fluids such as oil and natural gas can be obtained from subterranean geologic formations, referred to as a reservoir, by drilling a wellbore. For subsea applications, wellbores are formed through a subsea wellhead system that penetrates the hydrocarbon-bearing geologic formation. Once a wellbore is drilled, various forms of well completion components may be installed to control and enhance the efficiency of producing the various fluids from the reservoir. Electrified subsea production systems rely on subsea wellhead wet-mate feedthrough connectors to provide electrical communication and/or power transmission between downhole instrumentation such as sensors, gauges, downhole valves or other equipment, and surface or subsea located control systems while providing full pressure-containment through control and monitoring equipment at the wellhead, known as the christmas tree (XT).

These feedthrough connectors may be single channel or dual channel connectors with concentric contacts, requiring no orientation. Multi-pin connectors and feedthroughs may also be used. Poly-ether-ether-ketone (PEEK) over-molded pins are typically used throughout the entire electrical feedthrough system (EFS) architecture and offer both a conduit for electrical communication and a form of pressure barrier for pressures produced during well operation.

The PEEK over-molded pin within the wet-mate receptacle is exposed to the surrounding environment and its conditions. PEEK is typically used because it is resistant to harsh chemicals and corrosive environments found in wells and operates at broad temperature ranges. PEEK pins are typically welded onto the receptacle body, which forms the primary pressure barrier during operating conditions. In this configuration, the pin experiences a differential pressure across the welded profile that makes the thermoplastic material susceptible to creep if exposed to extreme pressures and temperatures. Accordingly, a feedthrough connector that is resistant to creep may be advantageous.

SUMMARY

In some embodiments, a receptacle for a downhole system includes a pressure seal for isolating a first pressure and a second pressure and a transmission pin that passes through the pressure seal. A pressure compensation chamber is positioned within the receptacle between the first pressure and the second pressure and has a chamber pressure sealed from the first pressure and the second pressure. The transmission pin is partially positioned in the pressure compensation chamber and a pressure compensation device positioned in the pressure compensation chamber equalizes the chamber pressure with the first pressure.

In some embodiments, a feedthrough connection assembly for providing communication to downhole equipment from a control system includes a wetmate plug and a wetmate receptacle. The wetmate receptacle includes a receptacle housing configured to be exposed to a gallery pressure and a downhole pressure. A transmission pin is positioned within the receptacle housing and a pressure compensation chamber is positioned within the receptacle housing between the gallery pressure and the downhole pressure. The transmission pin is partially positioned in the pressure compensation chamber and the wetmate receptacle includes a means for equalizing a chamber pressure of the pressure compensation chamber with the gallery pressure.

In some embodiments, a receptacle for a downhole system includes a pressure seal for isolating a gallery pressure and a downhole pressure and a transmission pin that passes through the pressure seal. The transmission pin includes a susceptible portion that has a glass transition temperature at an environmental temperature in which the receptacle is configured to be implemented. A pressure compensation chamber is positioned within the receptacle between the gallery pressure and the downhole pressure and has a chamber pressure sealed from the gallery pressure and the downhole pressure. The susceptible portion of the transmission pin is partially positioned in the pressure compensation chamber and at least one metallic bellows is positioned in the pressure compensation chamber for equalizing the chamber pressure with the gallery pressure.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

To describe the manner in which the above-recited and other features of the disclosure can be obtained, a more particular description will be rendered by reference to specific embodiments thereof, which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIGS. 4-1 and 4-2 are side section views of a wetmate receptacle, according to at least one embodiment of the present disclosure;

FIGS. 5-1 and 5-2 are side section views of a pressure compensation device, according to at least one embodiment of the present disclosure;

FIGS. 6-1 and 6-2 are side section views of a pressure compensation device, according to at least one embodiment of the present disclosure; and FIGS. 7-1 and 7-2 are side section views of a pressure compensation device, according to at least one embodiment of the present disclosure;

DETAILED DESCRIPTION

This disclosure generally relates to feedthrough assemblies for facilitating data and/or power transmission between downhole and/or subsea components through a transmission pin. In various downhole and/or subsea environments, data communication and/or power transmission conductors may be run to facilitate communicating with, controlling, and/or powering various downhole components. Connections are made through feedthrough assemblies having mating male and female connectors. These feedthrough assemblies can often facilitate connection of transmission lines through sealed components such as wellheads, christmas trees, etc. Thus, the feedthrough assemblies, in addition to providing connection of transmission lines, must also maintain pressure barriers in order to preserve the integrity of the system to contain production and other downhole fluids.

Feedthrough connection assemblies typically implement insulative components for insulating or shielding conductor components from the corrosive and otherwise harsh operational environments. These insulative components are typically made from polymer materials, such as poly-ether-ether-ketone (PEEK). While PEEK exhibits favorable material properties for withstanding the harsh environment, when elevated temperatures cause the PEEK to approach its glass transition temperature, the mechanical properties of the PEEK can begin to decline. Particularly, PEEK can be susceptible to creep or material flow based on a differential pressure experienced by different portions of the PEEK-formed material on opposing sides of a pressure seal. The creep of the PEEK material in this way can risk failure of the pressure containment of the feedthrough system, which can lead to catastrophic blow outs, among other undesirable conditions.

The pressure compensated feedthrough assemblies of the present disclosure include a pressure chamber positioned between a first, gallery pressure, and a second, downhole pressure. The pressure compensation chamber includes a pressure compensation device, such as a metallic bellows, which is both exposed to and operated by the first pressure. The bellows expands and contracts into the pressure compensation chamber thereby affecting a change to a chamber pressure. The pressure compensation chamber is filled with a dielectric fluid that transfers the chamber pressure to the PEEK material in the chamber. Based on the operation of the bellows, the chamber pressure of the pressure compensation chamber is balanced or equalized to substantially the same pressure as the first (gallery) pressure such that the PEEK material experiences the same pressure on both sides of a pressure seal. In this way, despite the PEEK material operating at, near, or nearer its glass transition temperature, the pressure compensation chamber limits or prevents the material from experiencing creep such that the integrity of the feedthrough assembly is preserved, and the downhole fluids and pressure can be properly contained.

Figure 1:
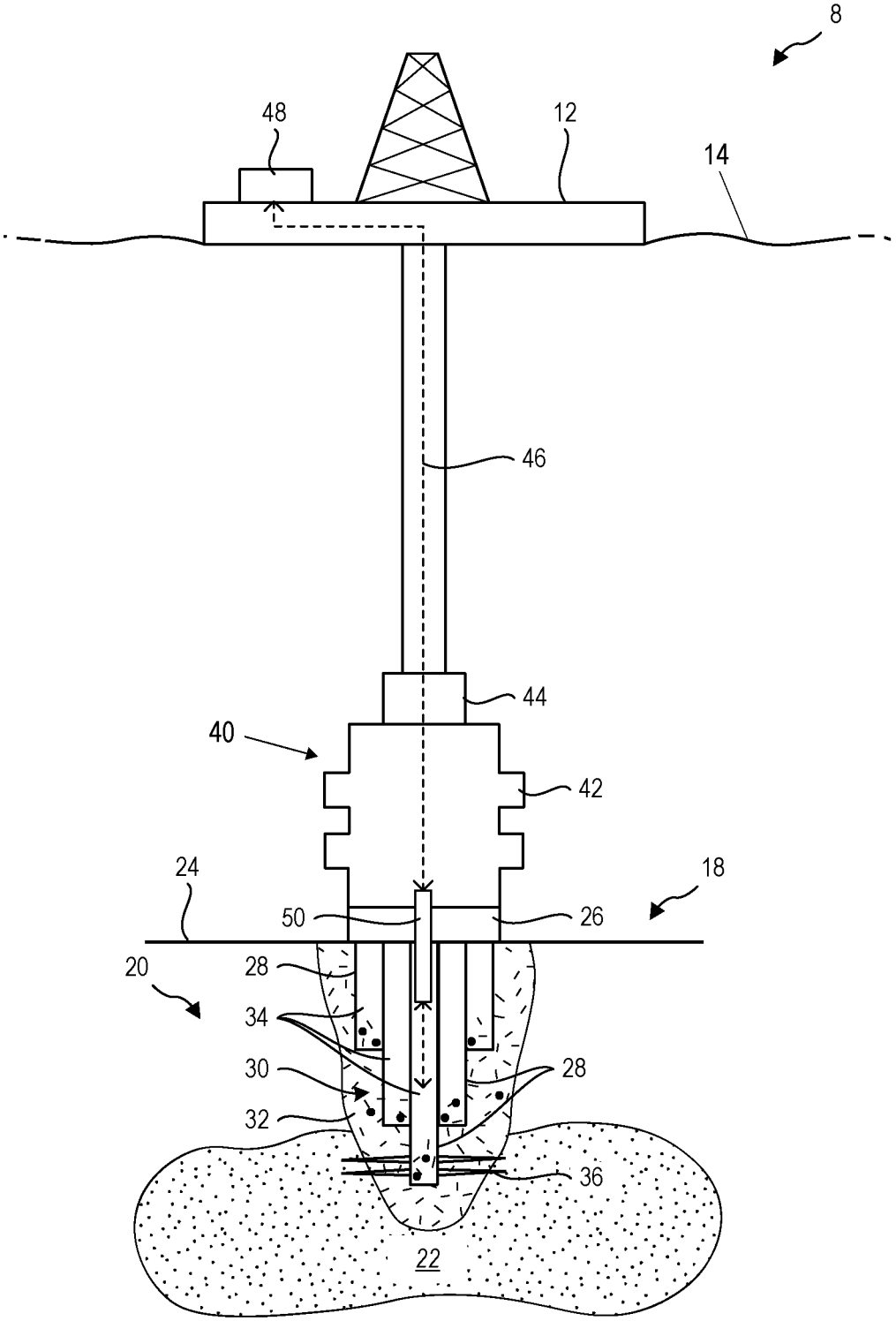
FIG. 1 is an example of a downhole system, according to at least one embodiment of the present disclosure.

Additional details will now be provided regarding systems described herein in relation to illustrative figures portraying example implementations. FIG. 1 is an example of a downhole system 8, according to at least one embodiment of the present disclosure. The downhole system 8 may be configured to extract various minerals, such as oil, gas and/or hydrocarbons from the earth. In the illustrated embodiment, the downhole system 8 is subsea (e.g., a subsea system, an offshore system, etc.). In certain embodiments, the downhole system 8 may be land-based (e.g., a surface system). The downhole system 8 may include a surface vessel or platform 12, such as a rig, generally located at a first surface 14 (e.g., a sea surface or a land surface).

The downhole system 8 may include a wellhead assembly 18 (e.g., a wellhead system, a subsea wellhead assembly) located below the first surface 14. In some embodiments, the wellhead assembly 18 may be located at a second surface 24 (e.g., sea floor, seabed, mudline, etc.). For instance, the wellhead assembly 18 and/or the second surface 24 may be located at greater than or equal to approximately 500 meters (m), 1,000 m, 2,000 m, 3,000 m, or more below the first surface 14. The wellhead assembly 18 couples to a well 20 to enable extraction of minerals from a subterranean formation 22 (e.g., a reservoir, a mineral deposit, etc.) disposed below the second surface 24 of the earth. The wellhead assembly 18 may include a wellhead 26 (e.g., wellhead housing), which may be generally located at or near the second surface 24.

The wellhead assembly 18 may include a plurality of coaxial strings 28 (e.g., pipes, casing, and/or tubing) that extend from the wellhead 26 into a wellbore 30 of the well 20. The strings 28 may be cemented into place in the well 20. In particular, cement 32 may be disposed between the strings 28 and the subterranean formation 22, for example, to block or prevent unintentional flow of fluids (e.g., oil, gas, and/or hydrocarbons) from the subterranean formation 22 to the surface 24 or to other subterranean formations below the surface 24. In some embodiments, the cement 32 may extend into annuli 34 formed between the strings 28. Further, the wellhead assembly 18 may include a plurality of perforations 36 (e.g., holes) that extend through the cement 32 and at least one string 28 of the plurality of strings 28 (e.g., casing strings) to establish fluid communication between the subterranean formation 22 and the wellhead assembly 18.

The wellhead assembly 18 may include multiple components that control and regulate activities and conditions associated with the well 20. For example, the wellhead assembly 18 may include components, such as bodies, valves, seals, a tree (e.g., a Christmas tree), and so forth, that route minerals extracted from the subterranean formation 22, regulate pressure in the well 20, and/or inject chemicals into the well 20. In some embodiments, the wellhead assembly 18 may be coupled to a blowout preventer (BOP) assembly 40 configured to seal the well 20 to block or prevent oil, gas, hydrocarbons, and/or other fluids from exiting the well 20 in the event of an unintentional release of pressure or an overpressure condition. In some embodiments, the BOP assembly 40 may include one or more of a BOP 42 (e.g., a BOP stack) and a lower marine riser package (LMRP) 44. The BOP 42 may include one or more preventers, spools, valves, and/or controls and may be operatively coupled to the wellhead 26 of the wellhead assembly 18. The LMRP 44 may be operatively coupled to the BOP 42 and a conduit 46 (e.g., a riser, a marine riser, a pipeline, etc.) extending from the surface vessel or platform 12. The LMRP 44 may include a ball/flex joint coupled to the conduit 46, a conduit adapter (e.g., a marine riser adapter), and kill and auxiliary lines.

The downhole system 8 may include a control system 48 (e.g., a surface controller, a topside controller, a processor-based controller, a master control module, etc.) for providing communication (e.g., electrical or optical) and/or power transmission to various subsurface components. The control system 48 may be generally located at the first surface 14 but may be located and/or may include components located at any other location. In some embodiments, the control system 48 may be disposed on the surface vessel or platform 12. The control system may communicate with (e.g., data communication, power transmission, monitoring, controlling, etc.) various subsurface components for enhancing the efficiency and safety of producing minerals from the formation 22. For instance, the control system 48 may communicate with permanently installed downhole sensors, gauges and other instrumentation and/or may power downhole valves or other equipment.

The control system 48 may be connected to these downhole components via a connector 50 such as a subsea wellhead wet-mate feedthrough connector or a feedthrough connection assembly. In some embodiments, the connector 50 may be positioned at and may penetrate the wellhead 26, however, the connector 50 may be positioned at any other location, such as in the wellbore 30. In addition to facilitating communication of the control system 48, the connector may provide pressure containment of the well 20 through the wellhead assembly 18 (e.g., wellhead 26, christmas tree, etc.)

Figure 2:
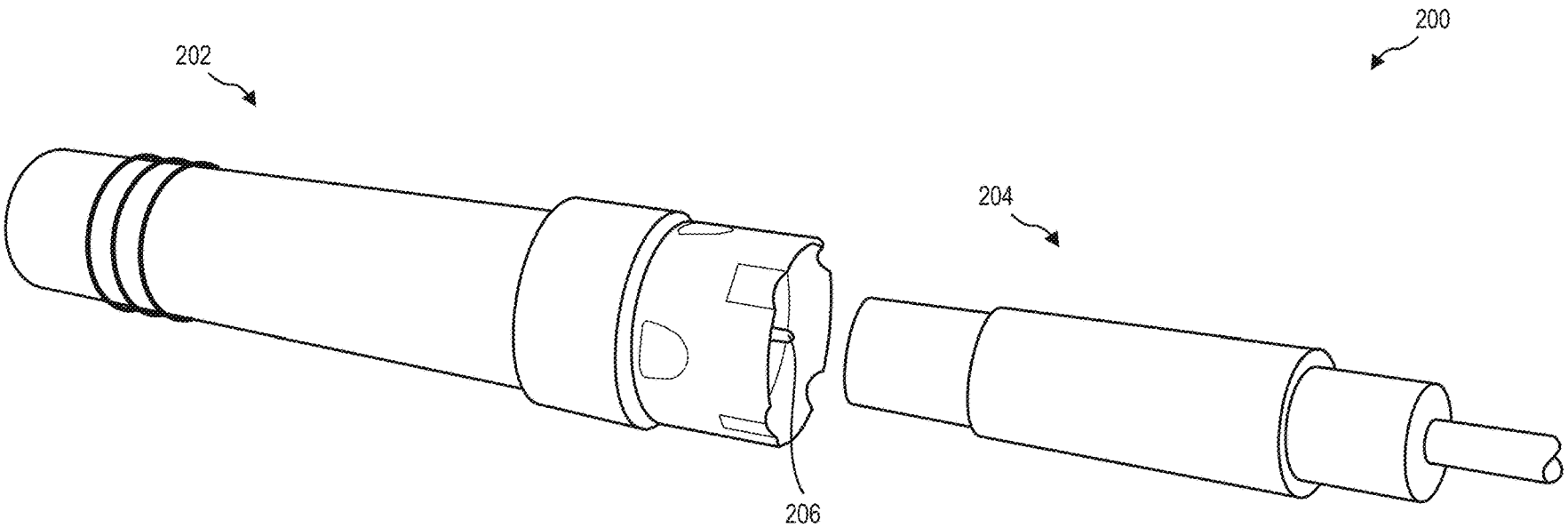
FIG. 2 is an example of a feedthrough connection assembly, according to at least one embodiment of the present disclosure.

FIG. 2 is an example of a feedthrough connection assembly 200, according to at least one embodiment of the present disclosure. The feedthrough connection assembly 200 may facilitate a connection between a surface control system and one or more downhole components as described herein. As used here, a connector such as the feedthrough connection assembly 200 being described as providing a "connection," providing "communication," or the like should be understood as providing a data connection or communication (e.g., electrical and/or optical), providing power transmission, or both. The feedthrough connection assembly 200 may also facilitate a pressure-sealed connection to maintain a pressure integrity of a wellbore with which the feedthrough connection assembly 200 is implemented.

The feedthrough connection assembly 200 is formed through a connection of a receptacle assembly 202 and a plug assembly 204 (e.g., a wetmate receptacle and a wetmate plug). The receptacle assembly 202 may be a female connection component and the plug assembly 204 may be a male connection component. For example, the plug assembly 204 may insert into and connect to the receptacle assembly 202. In some embodiments, the feedthrough connection assembly 200 may be a wetmate connector. For example, the feedthrough connection assembly 200 may be configured to be implemented in a wet environment and/or exposed to one or more fluids, such as seawater, downhole fluids, etc. The feedthrough connection assembly 200 may be configured such that the receptacle assembly 202 and plug assembly 204 may be (e.g., initially) exposed to the wet environment in a separate or disconnected configuration, and the connection of the receptacle assembly 202 and plug assembly 204 may be made in the wet environment.

Communication through the receptacle assembly 202 may be provided via a transmission pin 206. The transmission pin 206 may be positioned within a housing of the receptacle assembly 202 (e.g., at a central axis) and may extend such that, upon connection of the receptacle assembly 202 with the plug assembly 204, the transmission pin may extend at least partially into the plug assembly to connect with the plug assembly. The transmission pin(s) 206 may include one or more electrical conductors for providing data and/or power transmission through the feedthrough connection assembly 200. For instance, the transmission pin 206 may include a contact for connecting an electrical conductor of the plug assembly 204 with an electrical conductor of the receptacle assembly 202. In some embodiments, the transmission pin 206 includes two or more contacts for facilitating several distinct connections, for example, through a single pin. For instance, the several contacts may be arranged concentrically such that multiple connections may be made irrespective of an orientation of the plug assembly 204 and the receptacle assembly 202. In some embodiments, the receptacle assembly 202 includes multiple transmission pins 206. The multiple transmission pins 206 may each have single contacts, may each have multiple contacts, or the transmission pins 206 may be a combination of single contact and multi-contact pins. In this way, the feedthrough connection assembly 200 may provide communication through the transmission pin(s) 206.

The feedthrough connection assembly 200 may typically be oriented such that the receptacle assembly 202 is positioned downhole of the plug assembly 204. For instance, as described herein, the receptacle assembly 202 may include one or more components for containing, sealing, or otherwise preventing a downhole or downhole pressure or fluid flow from penetrating past the feedthrough connection assembly 200, as well as pressure compensating means for protecting one or more components. However, the feedthrough connection assembly 200 may be oriented in any other orientation, such as with the plug assembly 204 being implemented downhole of the receptacle assembly 202. Additionally, while the receptacle assembly 202, or female connection, is described herein as including various sealing and/or pressure compensating components, it should be understood that the plug assembly 204, or other equivalent male connection, may also be implemented with one or more of these components for facilitating the objectives of the feedthrough connection assembly described herein and without departing from the scope and spirit of the present disclosure.

Figure 3:
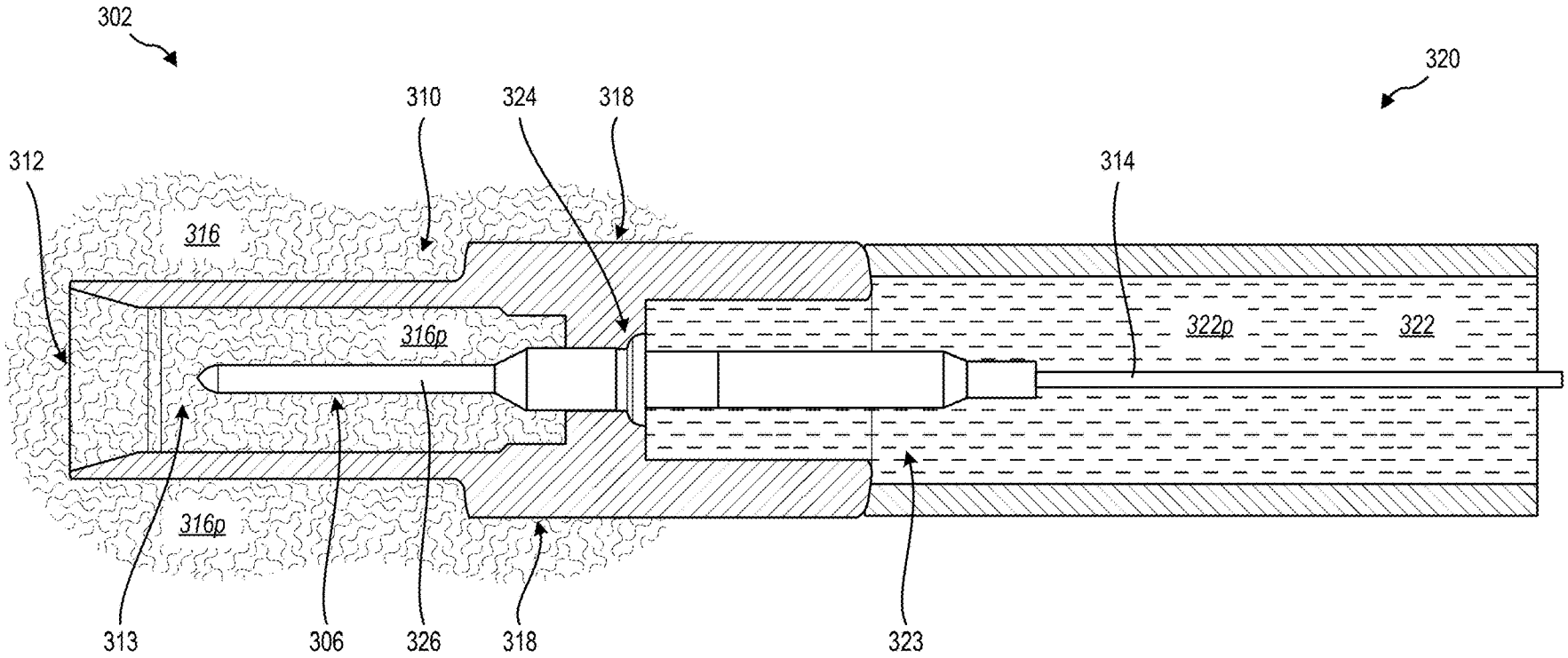
FIG. 3 is a side section view of a wetmate receptacle, according to at least one embodiment of the present disclosure.

FIG. 3 is a side section view of a wetmate receptacle 302, according to at least one embodiment of the present disclosure. The wetmate receptacle 302 includes a receptacle housing 310 that may be tubular in shape. The receptacle housing 310 may connect to and/or within a tubular tool assembly 320, such as mating with and/or within a drill pipe or completion pipe within a wellbore. The receptacle housing 310 includes a female connection 312 at an end of the receptacle housing 310. The female connection 312 may mate or interface with a male connection of a plug assembly (not shown) for forming a connection of a feedthrough connection assembly as described herein.

The wetmate receptacle 302 includes a transmission pin 306. The transmission pin may facilitate an electrical and/or optical connection to a conductor 314 (e.g., electrical conductor and/or optical fiber) for connecting to various downhole equipment as described herein. For instance, the transmission pin 306 may be positioned within an inner volume 313 of the receptacle housing 310. The inner volume 313 may be a volume formed by the female connection 312 of the receptacle housing 310.

The wetmate receptacle 302 may be configured for implementation in a subsea, subsurface, and/or downhole environment. For example, the wetmate receptacle 302 may be exposed to an environmental fluid or gallery fluid 316. For instance, the gallery fluid 316 may be seawater, a wellbore or downhole fluid (e.g., in an annular space of a wellbore), a gas, or any other environmental fluid. In some embodiments, some or all of the wetmate receptacle 302 is exposed to the gallery fluid and/or some or all of the tubular tool assembly 320 is exposed to the gallery fluid 316.

The gallery fluid 316 may have a gallery pressure 316*p* and a gallery temperature based on the environment of the gallery fluid 316. For instance, the gallery pressure 316*p* may be a pressure at the sea floor, or a pressure in an annulus of a wellbore, etc. The wetmate receptacle 302 may be subject to the gallery pressure 316*p* at various locations of the receptacle housing 310. For example, the wetmate receptacle 302 may experience the gallery pressure 316*p* at an exterior surface 318 of the receptacle housing 310 based on the wetmate receptacle being positioned within the gallery fluid 316. In some cases, the wetmate receptacle 302 may experience the gallery pressure 316*p* at an inner volume 313 of the receptacle housing 310, for instance, within the female connection 312. For example, in some cases the wetmate receptacle 302 may not be connected to a corresponding plug assembly such that the gallery fluid 316 and gallery pressure 316*p* may be present with the inner volume 313. In other examples, the wetmate receptacle 302 may be connected to a corresponding plug assembly and the gallery fluid 316 and gallery pressure 316*p* may nevertheless be present in the inner volume 313. For instance, as described herein, a connection of the wetmate receptacle 302 with a corresponding plug assembly may be made in a wet environment, such as within the gallery fluid 316, such that the inner volume 313 may be at the gallery pressure 316*p* (e.g., may be equalized with the gallery pressure 316*p*). In some cases, the connection of the wetmate receptacle with a corresponding plug assembly may not be a sealed connection, such as a free-floating connection, and the gallery fluid 316 and gallery pressure 316*p* may be permitted to penetrate to the inner volume 313.

In some embodiments, the tubular tool assembly 320 may contain and/or may be subject to a flow of a downhole fluid 322. For instance, the downhole fluid 322 may be a production fluid including hydrocarbons, gas, water, minerals, or other fluids. The downhole fluid 322 may have a downhole pressure 322*p*. In some cases, the downhole fluid 322 is present within the tubular tool assembly 320 during a downhole operation, such as an operation to produce or extract the downhole fluid 322. In some embodiments, the downhole fluid 322 is present within the tubular tool assembly 320 as a result of a failure of one or more components causing the downhole fluid 322 to flow within the tubular tool assembly 320, for example, to the wetmate receptacle 302. In some embodiments, the downhole fluid 322 and downhole pressure 322*p* may be present in a tubular space 323 formed by the receptacle housing 310 and/or the tubular tool assembly 320. For instance, the downhole fluid 322 and downhole pressure 322*p* may extend at least partially into the receptacle housing 310. In some embodiments, the tubular tool assembly 320 may not contain the downhole fluid 322 to the extent that the downhole fluid 322 may not be present at, near, or within the tubular space 323. In such cases, however, the receptacle housing 310 may nevertheless experience a downhole pressure 322*p*, for example, representative of a pressure experienced on a downhole side of the receptacle housing 310 and/or a pressure present in the tubular space 323. In this way, the downhole pressure 322*p* may represent a pressure in the tubular space 323 based on a presence, or lack thereof, of the downhole fluid 322.

In order to prevent the gallery fluid 316 from flowing to and/or through the tubular tool assembly 320 and/or to prevent the downhole fluid 322 from flowing to and/or through the wetmate receptacle 302, the wetmate receptacle 302 may include a seal 324. The seal 324 may be a fluid seal and/or a pressure seal and may prevent the flow of one or both of the gallery fluid 316 and the downhole fluid 322 past the seal 324. For example, the wetmate receptacle may be positioned at and/or through a wellhead, and the seal 324 may prevent the gallery fluid 316 from flowing into the well and/or may prevent the downhole fluid 322 from escaping the well into the sea.

In some cases, the seal 324 may include a metallic component and may be welded to the receptacle housing 310. In some cases, the seal may include a sealing element, such as an elastic or compliant member or sealing surfaces for providing sealing, for example, in connection with a threaded connection. In this way, the receptacle housing may provide a pressure and/or fluid seal to prevent the flow of fluids through the wetmate receptacle.

As mentioned above, the transmission pin 306 may be positioned at least partially within the inner volume 313. In some cases, the transmission pin penetrates or passes through the seal 324 into the tubular space 323. The seal 324 may be sealed against the transmission pin 306 and/or the transmission pin 306 may be incorporated as part of the seal 324. In this way, data and/or power may be transmitted to downhole equipment through the transmission pin 306 to fulfill the purpose of the wetmate receptacle 302 as described herein.

The transmission pin 306 may include an insulation portion 326. For example, some or all of an exterior or exposed surfaces of the transmission pin 306 may be covered or overmolded with the insulation portion 326. The insulation portion 326 may provide insulation for the (e.g., electrical and/or optical) conductor(s) of the transmission pin 306, for example, against electrical shorts or interference, corrosion, temperature, pressure, etc. The insulation portion 326 may be formed and/or fitted over the conductor(s) of the transmission pin 306 and may be hermetically sealed, for example, to prevent fluid and/or pressure penetration through the receptacle housing 310 via the transmission pin 306 (e.g., between the insulation portion 326 and the conductor(s)). Additionally, the insulation portion 326 may be sealed (e.g., hermetically) with the seal 324 in order to maintain the integrity of the seal 324 to prevent fluid and/or pressure flow.

The insulation portion 326 may be made from and/or may include any suitable material with suitable insulative properties. For example, the insulation portion 326 may be made from polymers such as poly-ether-ether-ketone (PEEK), poly-ether-ketone-ketone (PEKK), poly-etherimide, polysulfones, durable high-performance polyimide-based plastics, and polytetrafluoroethylene (PTFE), or any other suitable plastic, polymer, or composite material. The insulation portion 326 may include ceramics, metals, alumina, zirconia, or glass materials. In accordance with at least one embodiment of the present disclosure, the insulation portion 326 may be made from PEEK. For example, in the subsea, subsurface, and/or downhole environment in which the wetmate receptacle 302 is configured to be implemented, transmission pin 306 may be subject to various chemicals, temperatures and other environmental factors that may tend to damage, wear, corrode, deform, or otherwise negatively impact the transmission pin 306. PEEK exhibits favorable resistance to harsh chemicals, corrosive environments, and can operate at a broad range of temperatures, including the elevated temperatures often found in downhole environments. Accordingly, the insulation portion 326 may be implemented with PEEK in order to provide protection for the conductor(s) of the transmission pin 306 from the harsh environment.

As mentioned, the transmission pin 306 may be partially positioned in the inner volume 313, may pass through the seal 324, and may partially be positioned in the tubular space 323. Accordingly, the transmission pin 306 may be exposed on one side to the gallery fluid 316 and/or gallery pressure 316*p*, and on another side to the downhole fluid 322 and/or downhole pressure 322*p*. In many cases, the gallery pressure 316*p* and the downhole pressure 322*p* may be different pressures. For example, the gallery pressure 316*p* may be greater than the downhole pressure 322*p*. In some cases the gallery pressure 316*p* may be less than the downhole pressure 322*p*. In some embodiments, the gallery pressure 316*p* may be up to 5000 psi, up to 10,000 psi, up to 15,000 psi, or greater. In some embodiments, the downhole pressure 322*p* may be 5000 psi, up to 10,000 psi, up to 15,000 psi, or greater. In some embodiments, the difference between the gallery pressure 316*p* and the downhole pressure 322*p* may be up to 200 psi, 500 psi, 750 psi, 1000 psi, 2000 psi, 5000 psi, 10,000 psi, 15,000 psi, or another value. In this way, the transmission pin 306 may be subject to a pressure differential arising from the differences in pressure on either side of the seal 324.

In some embodiments, the wetmate receptacle, and more specifically, the transmission pin 306 may be subject to elevated temperatures. For example, an environment (e.g., subsea, subsurface, downhole, etc.) of the wetmate receptacle may exhibit elevated temperatures based on a temperature of one or more of the gallery fluid 316 or the downhole fluid 322. For example, the environment may have an elevated temperature of 100° C., 125° C., 150° C., 175° C., 200° C., or any value therebetween.

In some embodiments, the insulation portion 326 of the transmission pin 306 may include or may be made of a material that has a glass transition temperature at or near the elevated temperatures of the environment. For example, as described above, in a particular example, the insulation portion 326 may include PEEK. PEEK may have a glass transition temperature of about 143° C. In other embodiments the insulation portion 326 may include one or more materials having a (e.g., different) glass transition temperature that is at or near the environmental temperature. The glass transition temperature may also fluctuate slightly based on an associated pressure applied to a material. Accordingly, based on the wetmate receptacle being implemented in this high-temperature environment, a temperature of the insulation portion 326 (or at least some of the insulation portion 326) of the transmission pin 306 may be elevated to at or near its glass transition temperature.

A glass transition temperature may be understood as a temperature at which amorphous materials (or amorphous regions within a semicrystalline material) experience a transition from a hard, rigid, and/or glassy state to a more flexible, fluid, or rubbery state. For instance, the viscosity of the material may change by many orders of magnitude. A temperature of a material increasing from its glass state, upwards past the glass transition temperature, may affect the strength, rigidity, or other mechanical behavior of the material. For instance, the insulation portion 326 operating at or near its glass transition temperature may affect the ability of the insulation portion 326 to retain its shape or form, withstand the gallery pressure 316*p* and/or downhole pressure 322*p*, maintain the seal 324, or other detrimental effects.

In an illustrative example, as described above, the transmission pin, and more specifically the insulation portion 326, may be exposed to both the gallery pressure 316*p* and the downhole pressure 322*p*, which may vary widely. Accordingly, a pressure differential may be applied across the insulation portion 326 as positioned on either side of the seal 324. This difference in pressure, when applied over a sustained period of time, may tend to cause the material of the insulation portion 326 to exhibit creep. The insulation portion 326 may be made of PEEK (or other material) that, when operating below its glass transition temperature and in its glassy state, has polymer chains that are frozen, rigid, and/or have limited molecular mobility. Accordingly, the PEEK may have a high stiffness and low creep rate such that the insulation portion 326 may adequately resist creep due to the pressure differential. However, when near, at, or above the glass transition temperature, the PEEK may transition to a more fluid, rubbery state, with polymer chains having significantly more mobility. Accordingly, the PEEK may have a lower stiffness and may be more subject to creep. For instance, due to the pressure differential, material within the insulation portion 326 may begin to flow from an area of higher pressure to an area of lower pressure. Accordingly, the PEEK may exhibit significant creep, time-dependent deformation, and/or material flow under a constant and sustained pressure differential at elevated temperatures. While this example is described with respect to the insulation portion 326 including PEEK, other materials may exhibit similar behaviors, including non-polymer materials.

The insulation portion 326 experiencing creep, even to a minor degree, can have a serious detrimental effect on the wetmate receptacle 302. For example, based on a deformation or change in shape of the insulation portion 326 resulting from creep, the (e.g., hermetic) seal between the insulation portion 326 and the conductor(s) of the transmission pin 306 may fail. Similarly, mating between the insulation portion 326 and the seal 324 may not adequately seal out pressures and/or fluids. Accordingly, the downhole fluid 322 and/or the gallery fluid 316 may be permitted to flow across the seal 324 and/or through the wetmate receptacle 302. Fluid flow in this way may cause myriad issues such as electrical shorts, signal interference, damage and/or erosion to one or more components, etc. Further, failure of the insulation portion 326 in this way may compromise the integrity of the wetmate receptacle 302 for containing the downhole fluid 322 within the wellbore. In this way, the insulation portion 326 may be a susceptible portion of the transmission pin 306 and/or of the wetmate receptacle 302 generally. For example, the insulation portion 326 may represent a susceptible portion that is susceptible to creep and/or failure of the transmission pin 306 and/or wetmate receptacle 302 to properly contain fluids and/or pressures.

Figures 1, 4:
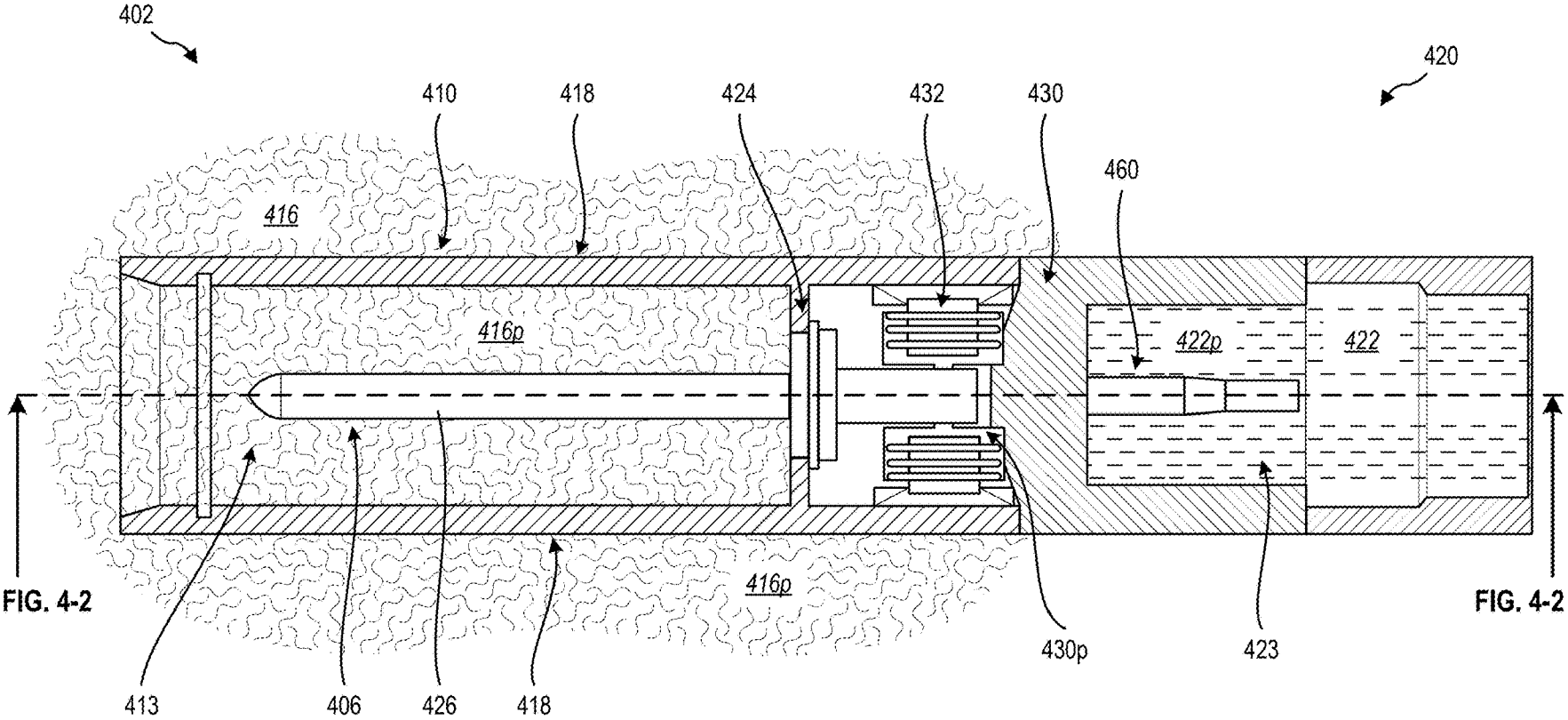
Figures 2, 4:
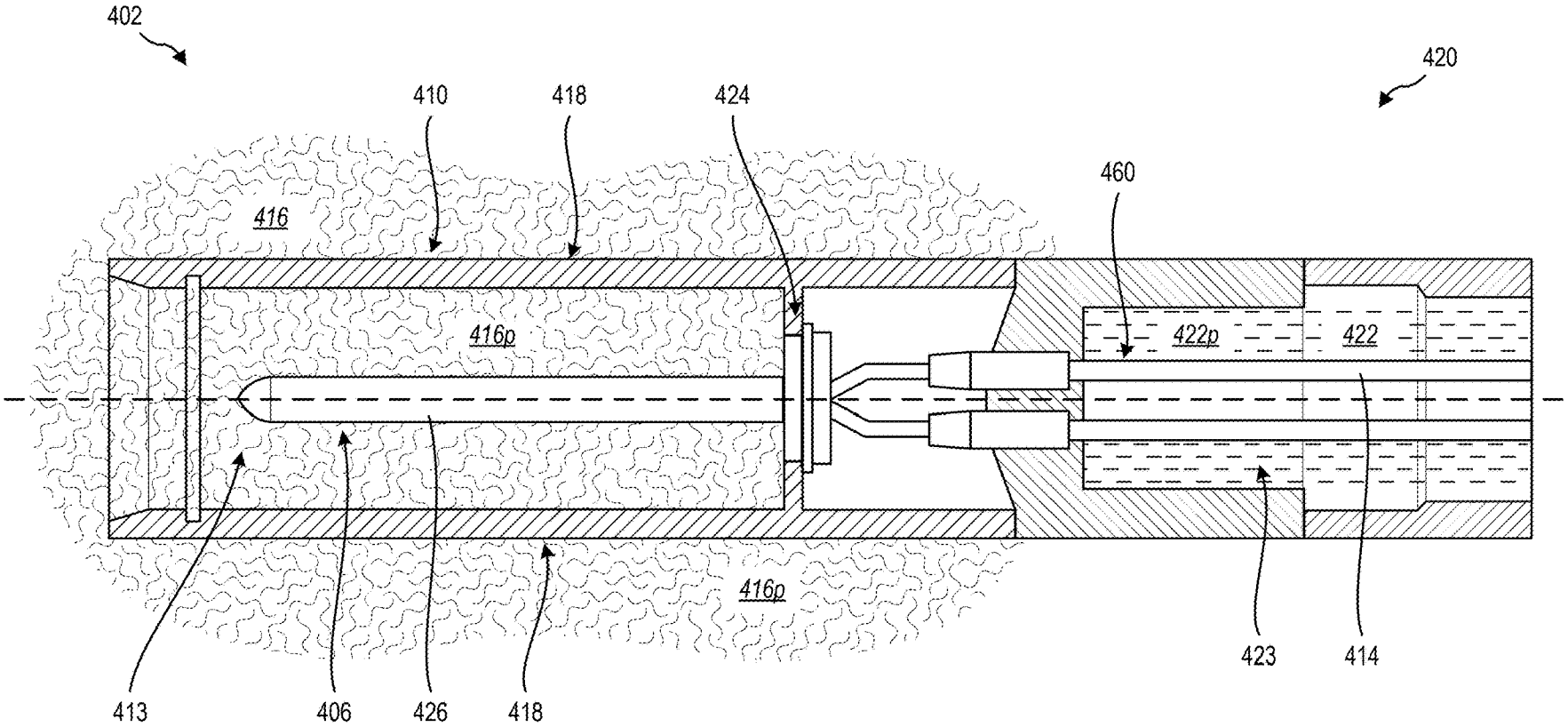

FIGS. 4-1 and 4-2 are side section views of a wetmate receptacle 402, according to at least one embodiment of the present disclosure. As shown, FIGS. 4-1 and 4-2 are section views of the wetmate receptacle 402 shown at a 90° rotation from each other. The wetmate receptacle 402 may include any of the features, may perform any of the functionalities, and/or may be implemented in any of the applications of one or more of the wetmate receptacles described herein, for example, such as that described in connection with the wetmate receptacle 302 of FIG. 3. The wetmate receptacle 402 may include one or more features for preventing creep, material flow, and/or deformation of the insulation portion 426 (or susceptible portion) of the transmission pin 406 as described herein.

In some embodiments, the wetmate receptacle 402 includes a receptacle housing 410 having an exterior surface 418 and an inner volume 413. The receptacle housing 410 may be subject or exposed to a gallery fluid 416 having a gallery pressure 416*p*. The receptacle housing 410 may be connected to a tubular tool assembly 420. A downhole fluid 422 and/or a downhole pressure 422*p* may be present within a tubular space 423 of the wetmate receptacle 402 and/or the tubular tool assembly 420. The wetmate receptacle 402 may include a seal 424 for providing a fluid and/or pressure seal through the wetmate receptacle, for example, to prevent fluid flow through the wetmate receptacle 402. A transmission pin 406 having an insulation portion 426 may be positioned within the receptacle housing 410 and may pass through the seal 424.

In some embodiments, the wetmate receptacle 402 includes a pressure compensation chamber 430. The pressure compensation chamber 430 maybe positioned between the inner volume 413 and the tubular space 423. For example, the pressure compensation chamber 430 may be adjacent the seal 424 and may be positioned between the seal 424 and the tubular space 423. The pressure compensation chamber 430 may be sealed from the inner volume 413 and the tubular space. For instance, the pressure compensation chamber 430 may be formed from a portion of the receptacle housing 410, such as machined or otherwise formed in a metal material of the receptacle housing 410. In this way, the pressure compensation chamber 430 may be isolated and/or sealed from the gallery fluid 416 and from the downhole fluid 422.

In some embodiments, the transmission pin 406 is positioned partially in the pressure compensation chamber 430. The transmission pin 406 may also be partially positioned in the inner volume 413. In some embodiments, the transmission pin 406 does not extend (e.g., past or through the pressure compensation chamber) to the tubular space 423. In this way, the transmission pin 406, and in particular the insulation portion 426, may be exposed to the gallery fluid 416 and gallery pressure 416*p*, and may not be exposed to the downhole fluid 422 and/or downhole pressure 422*p*, but rather may be exposed to a chamber pressure 430*p* of the pressure compensation chamber 430.

The pressure compensation chamber 430 may include a pressure compensation device 432. The pressure compensation device 432 may include any suitable means for compensating, balancing, or equalizing the chamber pressure 430*p* as described herein. For example, in accordance with at least one embodiment of the present disclosure, the pressure compensation device 432 includes one or more bellows for displacing a dielectric fluid within the pressure compensation chamber 430 in order to affect a change in the chamber pressure 430*p*.

The pressure compensation chamber 430 may facilitate equalizing, normalizing, and/or balancing the chamber pressure 430*p* with the gallery pressure 416*p*. For example, as described herein, the gallery pressure 416*p* may be made to or permitted to act on the pressure compensation device 432 in order that the chamber pressure 430*p* and the gallery pressure 416*p* are substantially similar, close, or the same. As described herein, the transmission pin 406 and insulation portion 426 may be exposed to both the gallery pressure 416*p* and the chamber pressure 430*p*. The pressure compensation device 432 may balance or equalize the chamber pressure 430*p* and gallery pressure 416*p* in order that the pressure acting on the insulation portion 426 is substantially the same or similar, for example, at all parts of the insulation portion 426 and/or on both sides of the seal 424. In some embodiments, the chamber pressure 430*p* may be balanced with the gallery pressure 416*p* when the two pressures are the same pressure. In some embodiments, the chamber pressure 430*p* may be balanced, equalized, or compensated with the gallery pressure 416*p* when the two pressures are within 10 psi, within 5 psi, within 3 psi, within 2 psi, or within 1 psi of each other.

Balancing the pressure on the insulation portion 426 in this way may prevent or reduce deformation and material creep of the insulation portion 426 (e.g., the susceptible portion). For example, because the pressures exerted on some or all of the insulation portion 426 are the same or similar, the material of the insulation portion 426 may have a reduced (or may not have substantially any) tendency to deform and/or flow, for instance, from a higher pressure to a lower pressure, even when operating at elevated temperatures upwards or near or at the glass transition temperature of the material of the insulation portion 426. In this way, the pressure compensation chamber 430 and pressure compensation device 432, by balancing or equalizing the chamber pressure 430*p* with the gallery pressure 416*p*, may facilitate the insulation portion 426 (susceptible portion) maintaining its form, shape, hermetic seal, and other mechanical properties and behaviors such that integrity of the wetmate receptacle 402 may be maintained and the pressures and fluids with which the wetmate receptacle 402 is implemented may be properly contained. In this way, data and/or power may be transmitted via the transmission pin 406 to one or more downhole components with a reduced risk of penetration of unwanted fluids and/or pressures through the wetmate receptacle 402. For example, FIG. 4-2 shows the transmission pin 406 having two contacts for providing connection to two conductors 414 of the tubular tool assembly 420. Any number of transmission pins 406 each having any number of contacts may be implemented in connection with the insulation portion 426 and the pressure compensation chamber 430 in this way to facilitate the connection to any number of corresponding conductors 414 through the wetmate receptacle 402 as described herein.

In some embodiments, the transmission pin 406 includes a feedthrough portion 460. The feedthrough portion 460 may be a portion of the transmission pin 406 having a coating, overmolded shield or layer, or other insulation (e.g., ceramic). The feedthrough portion 460 may be positioned adjacent the pressure compensation chamber 430 and may be exposed to the downhole fluid 422 and downhole pressure 422*p*. The feedthrough portion 460 may facilitate a connection of the transmission pin 406 with the one or more conductors 414. For example, the feedthrough portion 460 may protect the transmission pin 406 against the pressures, fluids, temperatures, etc. present in the wellbore and/or within the tubular tool assembly 420.

Figures 1, 5:
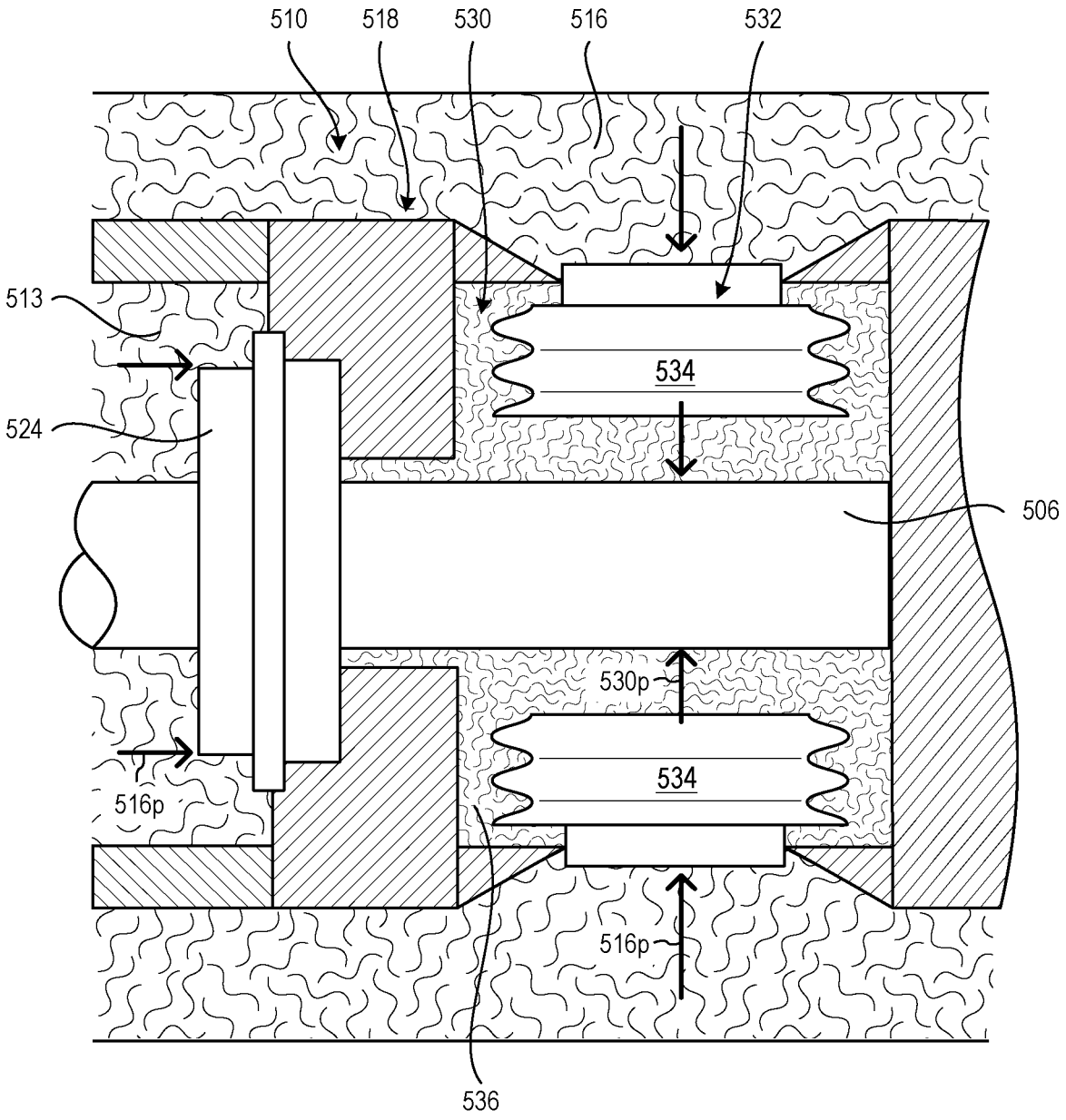
Figures 2, 5:
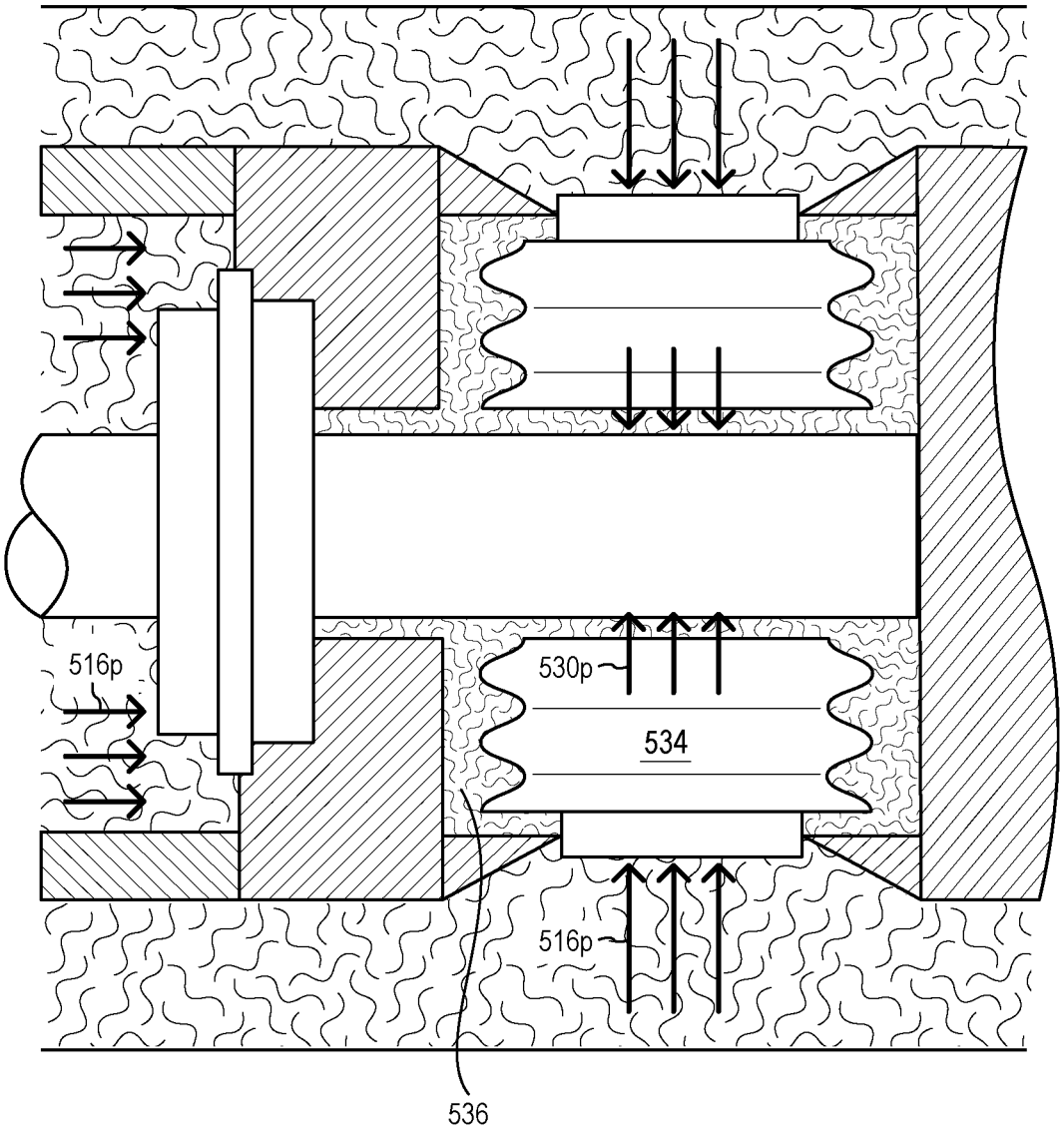

FIGS. 5-1 and 5-2 are side section views of a pressure compensation device 532, according to at least one embodiment of the present disclosure. The pressure compensation device 532 may be implemented in connection with the wetmate receptacle 402 of FIGS. 4-1 and 4-2, for example, for balancing or equalizing a chamber pressure 530*p* with a gallery pressure 516*p*.

The pressure compensation device 532 may be positioned within a pressure compensation chamber 530 formed within a receptacle housing 510 as described herein. The receptacle housing 510 may be exposed to a gallery fluid 516 such that the gallery fluid 516 and the gallery pressure 516*p* are present at an exterior surface 518 of the receptacle housing, as well as within an interior volume 513 of the receptacle housing 510.

The pressure compensation device 532 may include one or more bellows 534. The bellows 534 may be made of any suitable material, such as metal, plastic, polymer, or composite materials. In accordance with at least one embodiment of the present disclosure, the bellows 534 are metallic bellows. The bellows 534 may be a structure that can expand and/or contract based on a pressure differential. For example, the bellows 534 may be welded or otherwise joined to the receptacle housing 510 such that the bellows is exposed to the gallery fluid 516. Thus, the gallery fluid 516 may (e.g., freely) flow into and out of an inner volume of bellows 534. However, the bellows 534 may seal or prevent the gallery fluid 516 from flowing into the pressure compensation chamber 530. In this way, the pressure compensation chamber 530 may be fluidly isolated from the gallery fluid 516, but may be in pressure communication with (e.g., may exhibit the same pressure as) the gallery pressure 516*p* as described herein.

For instance, based on the gallery fluid 516 within the bellows 534, and more specifically, based on the gallery pressure 516*p* exerted on the bellows 534, the bellows 534 may be made to expand and/or contract. For example, FIG. 5-1 illustrates an operation of the bellows 534 with respect to a lower gallery pressure 516*p* and FIG. 5-2 illustrates an illustration of the bellows with respect to a higher gallery pressure 516*p*. Based on an increased or larger gallery pressure 516*p*, the bellows 534 may expand to fill more of the space within the pressure compensation chamber 530. Similarly, under less pressure, the bellows 534 may be made to contract to fill less of the space within the pressure compensation chamber 530.

The expansion and contraction (e.g., change in volume) of the bellows 534 may cause a change to the chamber pressure 530*p* within the pressure compensation chamber 530. For example, the pressure compensation chamber 530 may be filled partially or entirely with a fluid 536. The fluid 536 may be a gel, oil, liquid, or any other suitable fluid. The fluid 536 may be a dielectric fluid with electrically insulative properties such that electricity is not conducted by or through the fluid 536. In this way, the fluid 536 may not interfere with data and/or power transmission via the transmission pin 506, for example, in examples with electrical conductors. In some cases, the fluid 536 is a substantially incompressible fluid.

Based on the expansion and contraction of the bellows 534 (e.g., based on the bellows 534 occupying more or less volume within the pressure compensation chamber 530), the pressure exhibited by the fluid 536, or the chamber pressure 530*p* may change. Accordingly, the fluid 536 may exert a pressure on the transmission pin 506 at the chamber pressure 530*p*. The bellows being exposed to, and being operated by, the gallery pressure 516*p* may cause the chamber pressure 530*p* to be substantially similar to or the same as the gallery pressure 516*p*. In this way, the pressure acting on the transmission pin 506 within the pressure compensation chamber and the pressure acting on the transmission pin 506 within the interior volume 513 may be balanced or equal. Put another way, the transmission pin 506 may experience little or no pressure differential between portions of the transmission pin on either side of the seal 524.

In some embodiments, the bellows 534 may have an elastic property such that the bellows 534 may exhibit a spring, compliant, or biased behavior. For example, the bellows 534 may be biased toward a certain position or volume. The elastic behavior of the bellows 534 may facilitate (e.g., small) changes in volume and/or pressure of the fluid 536, for example, based on changes in temperature of the fluid 536.

The pressure compensation chamber 530 may be filled with the fluid 536 through one or more fill ports (not shown). For example, the fill ports may include holes, openings, valves, or other orifices through which the fluid 536 may be filled into the pressure compensation chamber 530, after which the fill ports may be closed or sealed. For example, the fill ports may be sealed with a welded, threaded, or other sealed connection. In some embodiments, the pressure compensation chamber 530 may be initially pressurized with an initial pressure of the chamber pressure 530*p*. For example, the pressure compensation chamber 530 may be pressurized at atmospheric pressure, for example, when the wetmate receptacle is assembled. Pressurizing the pressure compensation chamber 530 at atmospheric pressure may facilitate the pressure balancing techniques described herein. For example, the wetmate receptacle may be assembled and initially implemented with the interior volume 513 at atmospheric pressure. Thus, it may be advantageous for the pressure compensation chamber 530 to be at the same or similar pressure to the interior volume 513 upon assembly and/or initial implementation in order that the pressures may adequately be balanced and or equalized as described herein. In some embodiments, the pressure compensation chamber 530 may be implemented with an initial chamber pressure that is slightly negative or slightly positive (e.g., as compared to atmospheric pressure). For instance, the pressure compensation chamber 530 may be implemented with a pressure that is −20 psi, −10 psi, −5 psi, −2 psi, −1 psi, 0 psi, 1 psi, 2 psi, 5 psi, 10 psi, 20 psi, or another positive or negative pressure. The slight initial pressure in this way may help to accommodate the expansion or contraction of the fluid 536 due to the changes in temperature of the fluid 536 between assembly and operation.

In this way, the pressure compensation device 532 may facilitate balancing or equalizing the pressure exerted on some or all of the transmission pin 506. By balancing the chamber pressure 530*p* with the gallery pressure 516*p*, the pressure compensation device 532 may prevent or reduce material creep of a susceptible portion of the transmission pin 506 as described herein, thereby maintaining the integrity of a wetmate receptacle in which the transmission pin is implemented.

Figures 1, 6:
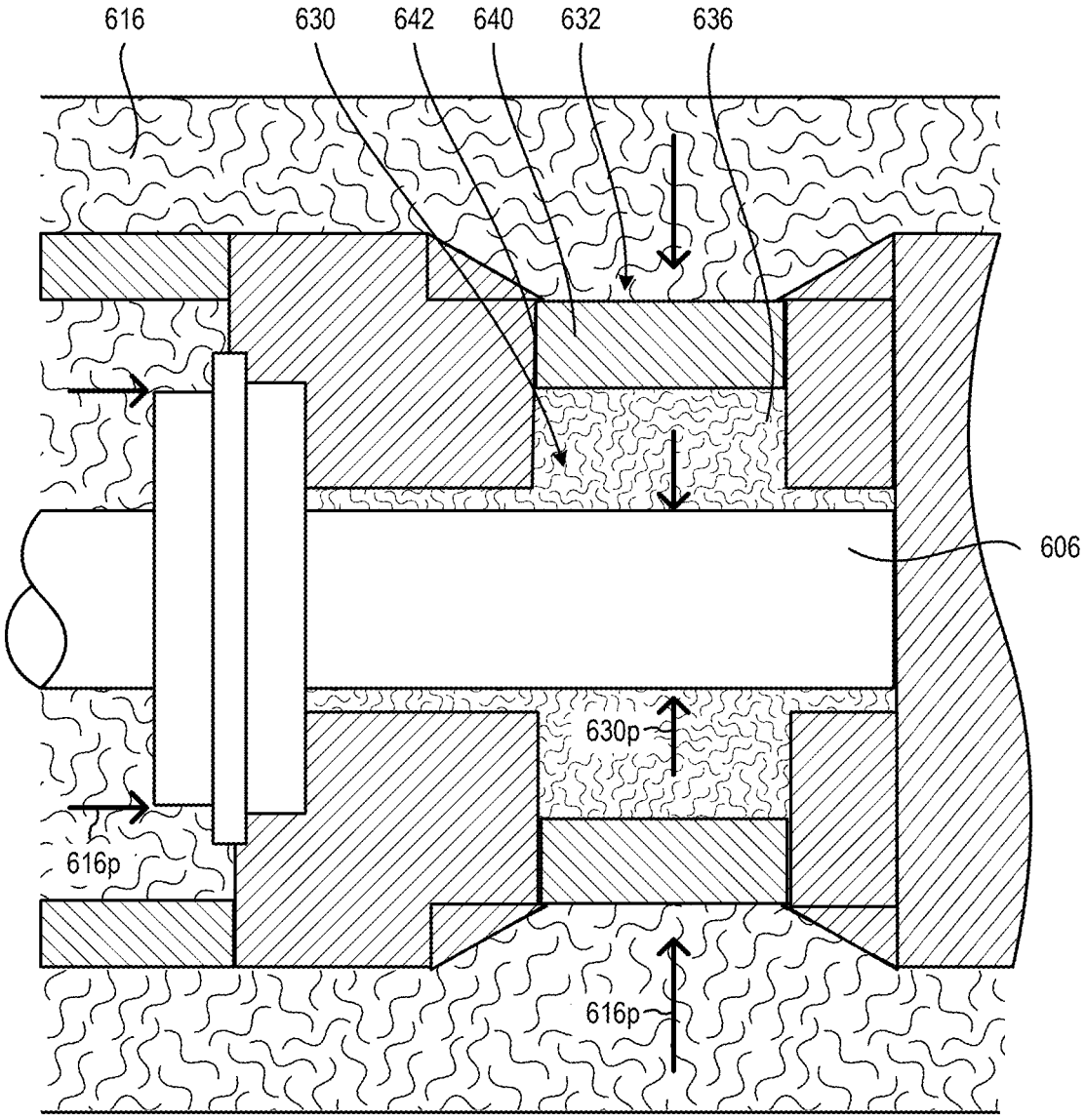
Figures 2, 6:
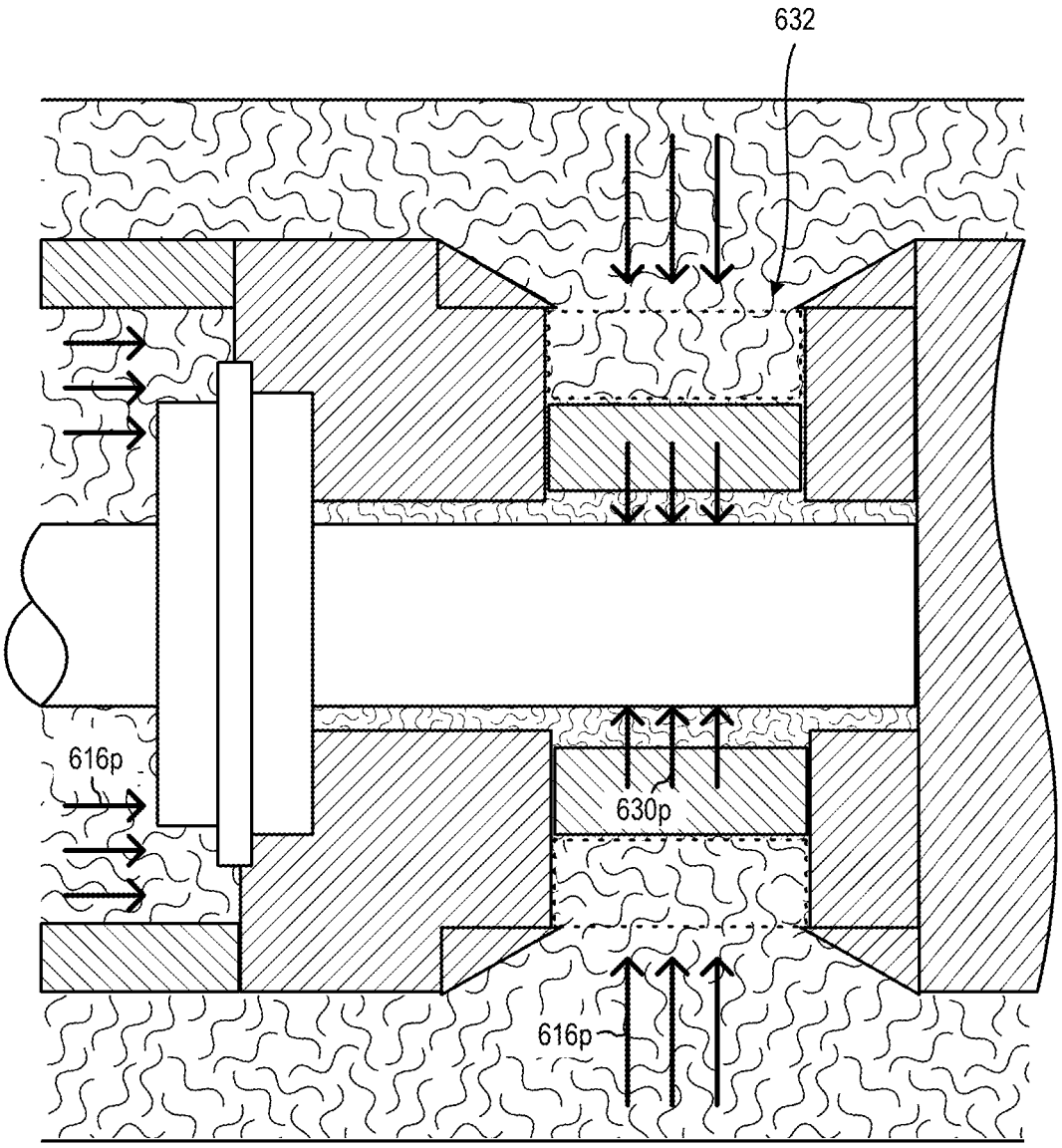

FIGS. 6-1 and 6-2 are side section views of a pressure compensation device 632, according to at least one embodiment of the present disclosure. The pressure compensation device 632 may be implemented in connection with any of the wetmate receptacles described herein, for example, for balancing or equalizing a chamber pressure 630*p* with a gallery pressure 616*p*.

The pressure compensation device 632 includes a piston 640. The piston 640 may be positioned within a corresponding cylinder 642 that may be in fluid communication with a pressure compensation chamber 630. For instance, the piston 640 may be in contact, on an inner side, with a fluid 636 that fills the pressure compensation chamber 630. The piston 640 may be exposed, on an outer side, to a gallery fluid 616 having the gallery pressure 616*p*.

The piston 640 may be sealed against the cylinder 642 such that the pressure compensation chamber 630 and fluid 636 are sealed and isolated from the gallery fluid 616, and vice versa. The pressure compensation chamber 630 and fluid 636 may be, however, in pressure communication with the gallery fluid 616 via the piston 640. For example, based on the gallery pressure 616*p*, the piston 640 may be driven inward or outward within the cylinder 642. For instance, FIG. 6-1 illustrates an operation of the piston 640 with respect to a lower gallery pressure 616*p* and FIG. 6-2 illustrates an illustration of the piston 640 with respect to a higher gallery pressure 616*p*. Based on an increased or larger gallery pressure 616*p*, the piston 640 may be driven inward to reduce the volume of the pressure compensation chamber 630, thereby increasing the chamber pressure 630*p*. Similarly, under less gallery pressure 616*p*, the piston 640 may be driven outward to increase the volume of the pressure compensation chamber 630, thereby decreasing the chamber pressure 630*p*. Thus, the chamber pressure 630*p* may change based on the operation of the piston 640 by the gallery pressure 616*p* such that the chamber pressure 630*p* is substantially the same as the gallery pressure 616*p*. In this way, the pressure compensation device 632 may facilitate applying a uniform pressure to the transmission pin 606 to prevent creep or other deformation of the transmission pin 606 as described herein.

Figures 1, 7:
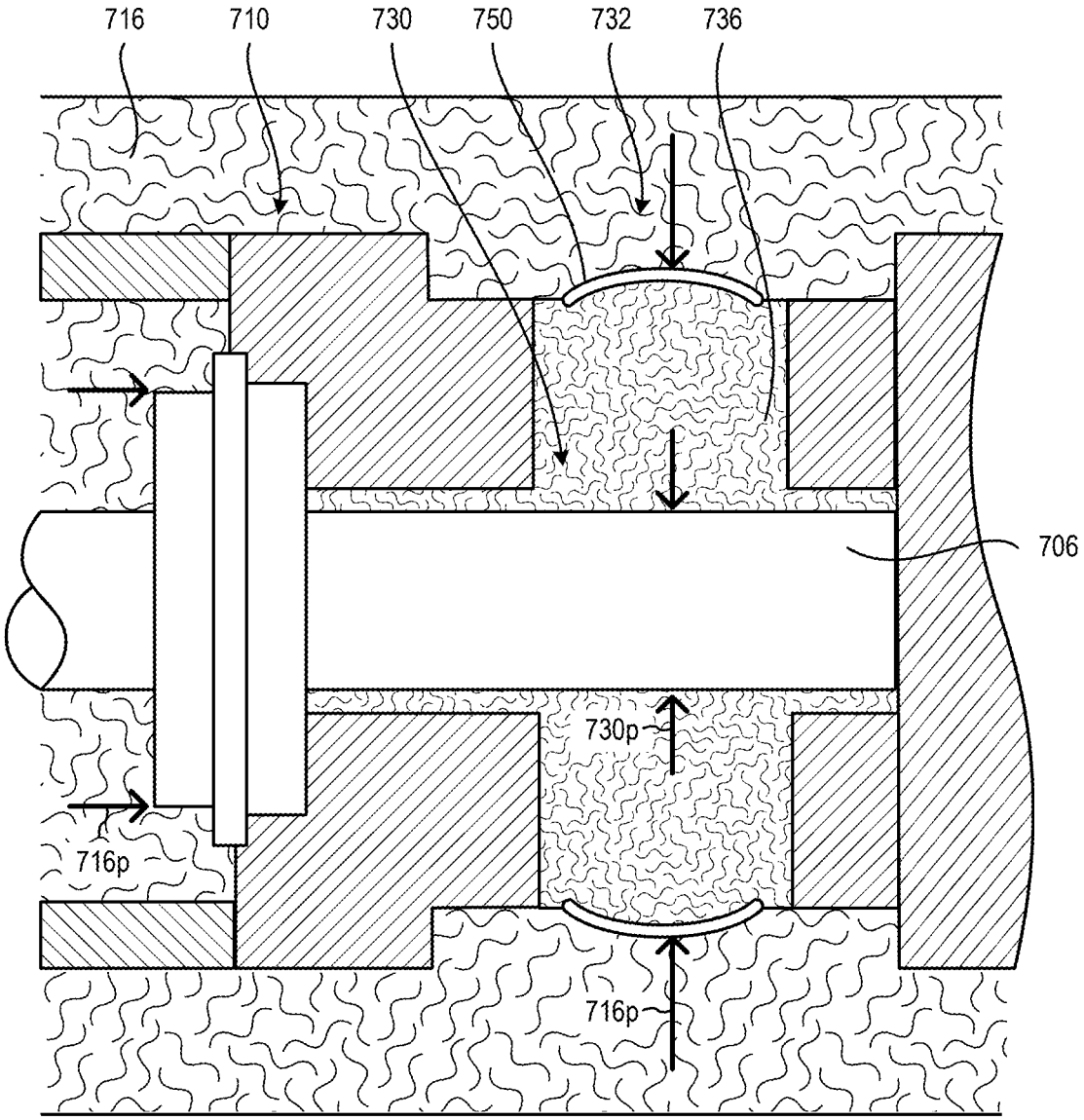
Figures 2, 7:
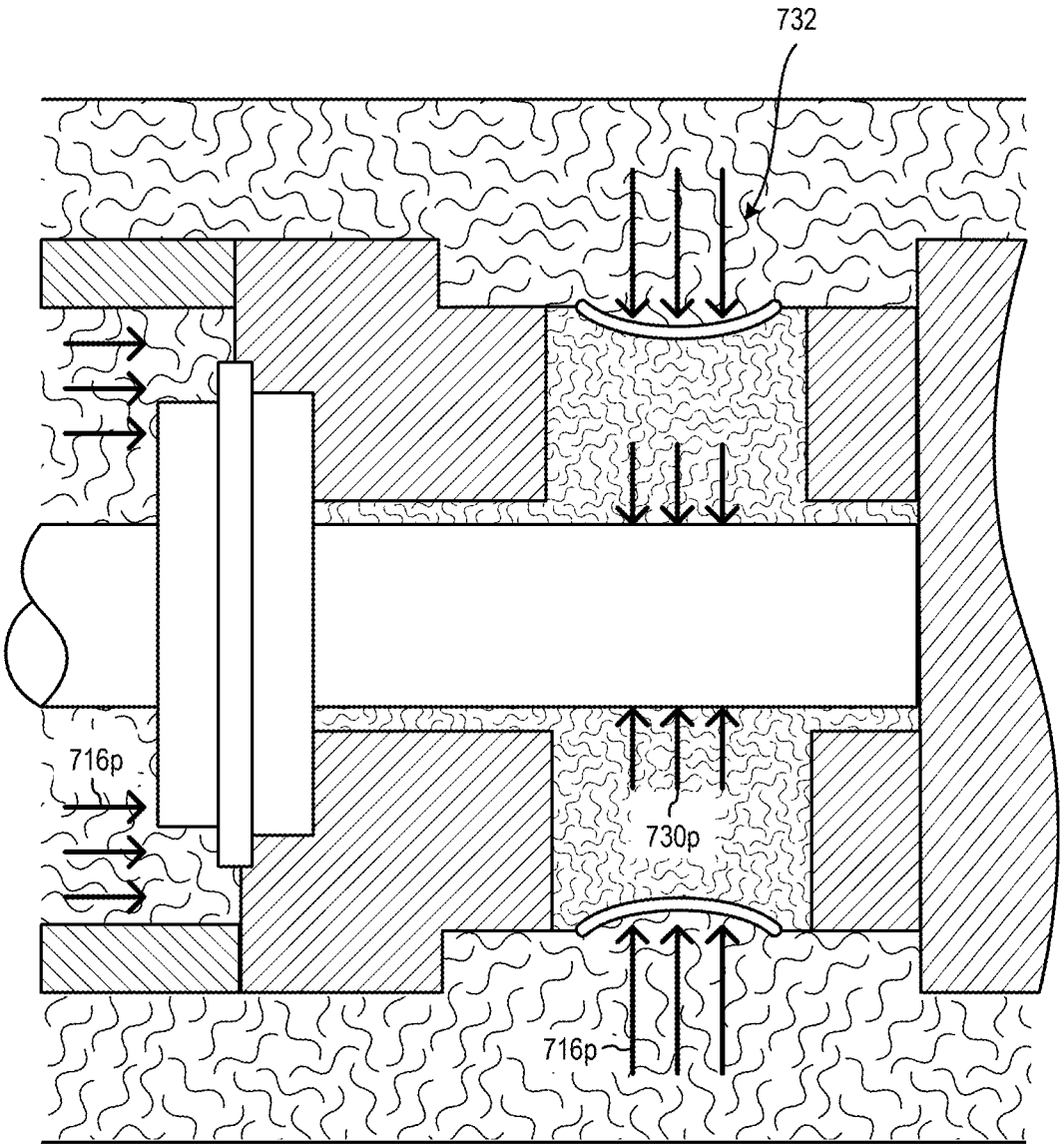

FIGS. 7-1 and 7-2 are side section views of a pressure compensation device 732, according to at least one embodiment of the present disclosure. The pressure compensation device 732 may be implemented in connection with any of the wetmate receptacles described herein, for example, for balancing or equalizing a chamber pressure 730*p* with a gallery pressure 716*p*.

The pressure compensation device 732 includes a diaphragm 750. The diaphragm 750 may be or may include metal, rubber, plastic, polymer, a composite material, or any other suitable material. The diaphragm 750 may be a component or structure that may flex and/or deform under the influence of a pressure differential or other applied forces. For example, the diaphragm 750 may be a flex disk, flexure, or other pressure-responsive component.

The diaphragm 750 may be in fluid communication with a pressure compensation chamber 730. For instance, the diaphragm 750 may be in contact, on an inner side, with a fluid 736 that fills the pressure compensation chamber 730. The diaphragm 750 may be positioned on an exterior surface of a receptacle housing 710 such that the diaphragm 750 is exposed, on an outer side, to a gallery fluid 716 having the gallery pressure 716*p*.

The diaphragm 750 may be sealed against the receptacle housing 710 such that the pressure compensation chamber 730 and fluid 736 are sealed and isolated from the gallery fluid 716, and vice versa. The pressure compensation chamber 730 and fluid 736 may be, however, in pressure communication with the gallery fluid 716 via the diaphragm 750. For example, based on the gallery pressure 716*p*, the diaphragm 750 may be flexed, deformed, or otherwise displaced inward or outward. For instance, FIG. 7-1 illustrates an operation of the diaphragm 750 with respect to a lower gallery pressure 716*p* and FIG. 7-2 illustrates an illustration of the diaphragm 750 with respect to a higher gallery pressure 716*p*. Based on an increased or larger gallery pressure 716*p*, the diaphragm 750 may be driven inward to reduce the volume of the pressure compensation chamber 730, thereby increasing the chamber pressure 730*p*. Similarly, under less gallery pressure 716*p*, the diaphragm 750 may be driven outward to increase the volume of the pressure compensation chamber 730, thereby decreasing the chamber pressure 730*p*. Thus, the chamber pressure 730*p* may change based on the operation of the diaphragm 750 by the gallery pressure 716*p* such that the chamber pressure 730*p* is substantially the same as the gallery pressure 716*p*. In this way, the pressure compensation device 732 may facilitate applying a uniform pressure to the transmission pin 706 to prevent creep or other deformation of the transmission pin 706 as described herein.

As described herein, the various pressure compensation devices may be implemented to reduce damage to wetmate receptacles thereby increasing tool life, reducing risk of failures such as blowouts, improving the operational performance and safety of feedthrough systems. Additionally, the pressure compensation devices being operated by and based on the gallery pressure may facilitate a simplicity and ease of implementation of the pressure compensation devices. For instance, the pressure compensation devices described herein may be passive devices (e.g., passive means) that are operated based solely on the change in environmental pressure of the gallery fluid, for example, in contrast to an actively controlled (e.g., electrical, hydraulic, etc.) device for balancing pressure.

While the embodiments shown herein have been shown and described with respect to a specific number and/or orientation of pressure compensation chambers and pressure compensation devices, it should be understood that the present disclosure is not so limited. Indeed, the wetmate receptacles described herein may be implemented with any number of pressure compensation chambers and pressure compensation devices. For example, while embodiments have shown wetmate receptacles implemented each with two pressure compensation chambers and 2 pressure compensation devices, it should be understood that the wetmate receptacles may be implemented with 1 pressure compensation chamber and pressure compensation device. Similarly, more than 2, such as 3, 4, 5, 6, 7, 8, 9, or 10 pressure compensation chambers and/or pressure compensation devices may be implemented. In some cases, multiple pressure compensation devices may be implemented in a single, common, or connected pressure compensation chamber. Additionally, while several embodiments of pressure compensation devices have been shown and described (e.g., in isolation), in some cases, multiple pressure compensation devices of different types may be implemented together, whether in the same or different pressure compensation chamber. In this way, the pressure compensation techniques described herein may be achieved in any of a number of different ways and configurations of the features, devices, and techniques described herein.

Further, while the wetmate receptacles have been shown and described primarily with respect to subsea and/or offshore implementations, as well as being implemented for passing through a wellhead or tree, it should be understood that the wetmate receptacles and feedthrough systems described herein may be implemented in any of a variety of situations. For example, the wetmate receptacles may be implemented in surface downhole systems. In another example, the wetmate receptacles may be implemented downhole (e.g., not necessarily just for traversing a wellhead) for facilitating an electrical and/or optical connection between components. Indeed, the wetmate receptacles described herein may be implemented in any location and in any situation for connecting electrical and/or optical (fiber) conductors in a wet environment, as well as for providing pressure compensation to prevent creep of susceptible portions.

INDUSTRIAL APPLICABILITY

The following description from ¶¶ [0073]-[0092] includes various embodiments that, where feasible, may be combined in any permutation. For example, the embodiment of ¶ [0073] may be combined with any or all embodiments of the following paragraphs. Embodiments that describe acts of a method may be combined with embodiments that describe, for example, systems and/or devices. Any permutation of the following paragraphs is considered to be hereby disclosed for the purposes of providing "unambiguously derivable support" for any claim amendment based on the following paragraphs. Furthermore, the following paragraphs provide support such that any combination of the following paragraphs would not create an "intermediate generalization."

In some embodiments, a receptacle for a downhole system includes a pressure seal for isolating a first pressure and a second pressure, a transmission pin that passes through the pressure seal, a pressure compensation chamber positioned within the receptacle between the first pressure and the second pressure and having a chamber pressure sealed from the first pressure and the second pressure, the transmission pin being partially positioned in the pressure compensation chamber, and a pressure compensation device positioned in the pressure compensation chamber for equalizing the chamber pressure with the first pressure.

in some embodiments, the transmission pin includes a susceptible portion that has a glass transition temperature at an environmental temperature in which the receptacle is configured to be implemented such that the susceptible portion is susceptible to creep.

In some embodiments, the susceptible portion is configured to be partially exposed to the first pressure such that the susceptible portion is susceptible to creep from a pressure differential.

In some embodiments, the susceptible portion is partially positioned in the pressure compensation chamber.

In some embodiments, the susceptible portion includes poly-ether-ether-ketone (PEEK).

In some embodiments, the susceptible portion is an insulation portion of the transmission pin for electrically insulating an electrical conductor of the transmission pin.

In some embodiments, the transmission pin includes one or more of an electrical conductor or an optical fiber.

In some embodiments, the transmission pin includes a feedthrough portion configured to be exposed to the second pressure.

In some embodiments, a feedthrough connection assembly for providing communication to downhole equipment from a control system includes a wetmate plug and a wetmate receptacle. In some embodiments, the wetmate receptacle includes a receptacle housing configured to be exposed to a gallery pressure and a downhole pressure, a transmission pin positioned within the receptacle housing, a pressure compensation chamber positioned within the receptacle housing between the gallery pressure and the downhole pressure, wherein the transmission pin is partially positioned in the pressure compensation chamber, and a means for equalizing a chamber pressure of the pressure compensation chamber with the gallery pressure.

In some embodiments, the means for equalizing include a passive means for passively equalizing the chamber pressure based on the gallery pressure.

In some embodiments, the means for equalizing includes at least one bellows positioned in the pressure compensation chamber.

In some embodiments, the at least one bellows is a metallic bellows.

In some embodiments, the at least one bellows is in pressure communication with the gallery pressure.

In some embodiments, the pressure compensation chamber is filled with a dielectric fluid.

In some embodiments, the dielectric fluid is an oil or a gel.

In some embodiments, the chamber pressure of the pressure compensation chamber is atmospheric pressure when the wetmate receptacle is assembled.

In some embodiments, the means for equalizing includes a piston positioned in the pressure compensation chamber and in pressure communication with the gallery pressure.

In some embodiments, the means for equalizing includes a diaphragm positioned on the pressure compensation chamber and in fluid communication with the gallery pressure.

In some embodiments, a receptacle for a downhole system includes a pressure seal for isolating a gallery pressure and a downhole pressure, a transmission pin that passes through the pressure seal, the transmission pin including a susceptible portion that has a glass transition temperature at an environmental temperature in which the receptacle is configured to be implemented, a pressure compensation chamber positioned within the receptacle between the gallery pressure and the downhole pressure and having a chamber pressure sealed from the gallery pressure and the downhole pressure, the susceptible portion of the transmission pin being partially positioned in the pressure compensation chamber, and at least one metallic bellows positioned in the pressure compensation chamber for equalizing the chamber pressure with the gallery pressure.

In some embodiments, the transmission pin is positioned within the receptacle such that susceptible portion is configured to be exposed to both the gallery pressure and the chamber pressure.

The embodiments of the pressure compensated feedthrough assemblies have been primarily described with reference to wellbore drilling operations; the pressure compensated feedthrough assemblies described herein may be used in applications other than the drilling of a wellbore. In other embodiments, the pressure compensated feedthrough assemblies according to the present disclosure may be used outside a wellbore or other downhole environment used for the exploration or production of natural resources. For instance, the pressure compensated feedthrough assemblies of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. Additionally, as used herein, the term "and/or" includes any and all combinations of one or more of the associated listed items.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A receptacle for a downhole system, comprising:

a pressure seal for isolating a first pressure and a second pressure;

a transmission pin that passes through the pressure seal, wherein the transmission pin includes a susceptible portion that has a glass transition temperature at an environmental temperature in which the receptacle is configured to be implemented such that the susceptible portion is susceptible to creep;

a pressure compensation chamber positioned within the receptacle between the first pressure and the second pressure and having a chamber pressure sealed from the first pressure and the second pressure, the transmission pin being partially positioned in the pressure compensation chamber; and a pressure compensation device positioned in the pressure compensation chamber for equalizing the chamber pressure with the first pressure.

2. The receptacle of claim 1, wherein the susceptible portion is configured to be partially exposed to the first pressure such that the susceptible portion is susceptible to creep from a pressure differential.

3. The receptacle of claim 2, wherein the susceptible portion is partially positioned in the pressure compensation chamber.

4. The receptacle of claim 1, wherein the susceptible portion includes poly-ether-ether-ketone (PEEK).

5. The receptacle of claim 1, wherein the susceptible portion is an insulation portion of the transmission pin for electrically insulating an electrical conductor of the transmission pin.

6. The receptacle of claim 1, wherein the transmission pin includes one or more of an electrical conductor or an optical fiber.

7. The receptacle of claim 1, wherein the transmission pin includes a feedthrough portion configured to be exposed to the second pressure.

* * * * *